US005437608A

United States Patent [19]

Cutler

[11] Patent Number: 5,437,608

[45] Date of Patent: Aug. 1, 1995

[54] MASSAGING APPARATUS WITH SEQUENTIAL VIBRATION

[75] Inventor: Stanley Cutler, Van Nuys, Calif.

[73] Assignee: JB Research, Inc., Los Angeles, Calif.

[21] Appl. No.: 963,285

[22] Filed: Oct. 19, 1992

[51] Int. Cl.[6] ..... A61H 1/00

[52] U.S. Cl. ..... 601/49; 601/57; 601/48

[58] Field of Search ..... 601/46, 48–54, 601/56–62, 65–70, 78, 107, 108, 111

[56] References Cited

U.S. PATENT DOCUMENTS

| | | | |
|---|---|---|---|
| Re. 31,603 | 6/1984 | Christensen | 128/33 |
| 2,924,216 | 2/1960 | Stewart | 128/33 |
| 3,446,204 | 5/1969 | Murphy | 128/33 |
| 3,678,923 | 7/1972 | Oetinger | 128/33 |
| 3,885,554 | 5/1975 | Rockwell | 128/24 R |
| 4,005,703 | 2/1977 | Rosen | 601/49 |
| 4,157,088 | 6/1979 | Gracey | 128/33 |
| 4,256,116 | 3/1981 | Meretsky | 128/421 |
| 4,779,615 | 10/1988 | Frazier | 128/33 |
| 5,007,410 | 4/1991 | DeLaney | 128/36 |
| 5,042,479 | 8/1991 | Brotz | 128/66 |
| 5,050,587 | 9/1991 | Sagara | 128/33 |
| 5,188,096 | 2/1993 | Yoo | 128/33 |

FOREIGN PATENT DOCUMENTS

| | | | |
|---|---|---|---|
| 328276 | 11/1987 | Germany | 128/32 |
| 2241894 | 9/1991 | United Kingdom | 128/33 |

*Primary Examiner*—Robert A. Hafer
*Assistant Examiner*—David J. Kenealy
*Attorney, Agent, or Firm*—Lewis B. Sternfels

[57] ABSTRACT

An electromechanical apparatus is disclosed herein such as a cushion, pad or mattress, including pulsing elements for massaging a variety of body locations having a plurality of vibrating transducers situated in groups within a cushioned member so that the groups of transducers operate in given locations or sections of the cushioned member to provide either an automatic or manually controlled rolling or travelling vibratory motion across the member. A manually operated dwell of the vibratory motion is provided at selected locations. A handheld controller supplies the groups of transducers with electrical signals to produce an operating sequence of vibratory oscillations in individual transducers as well as selected groups and the aforementioned rolling or travelling vibratory motion.

22 Claims, 4 Drawing Sheets

Fig. 1.
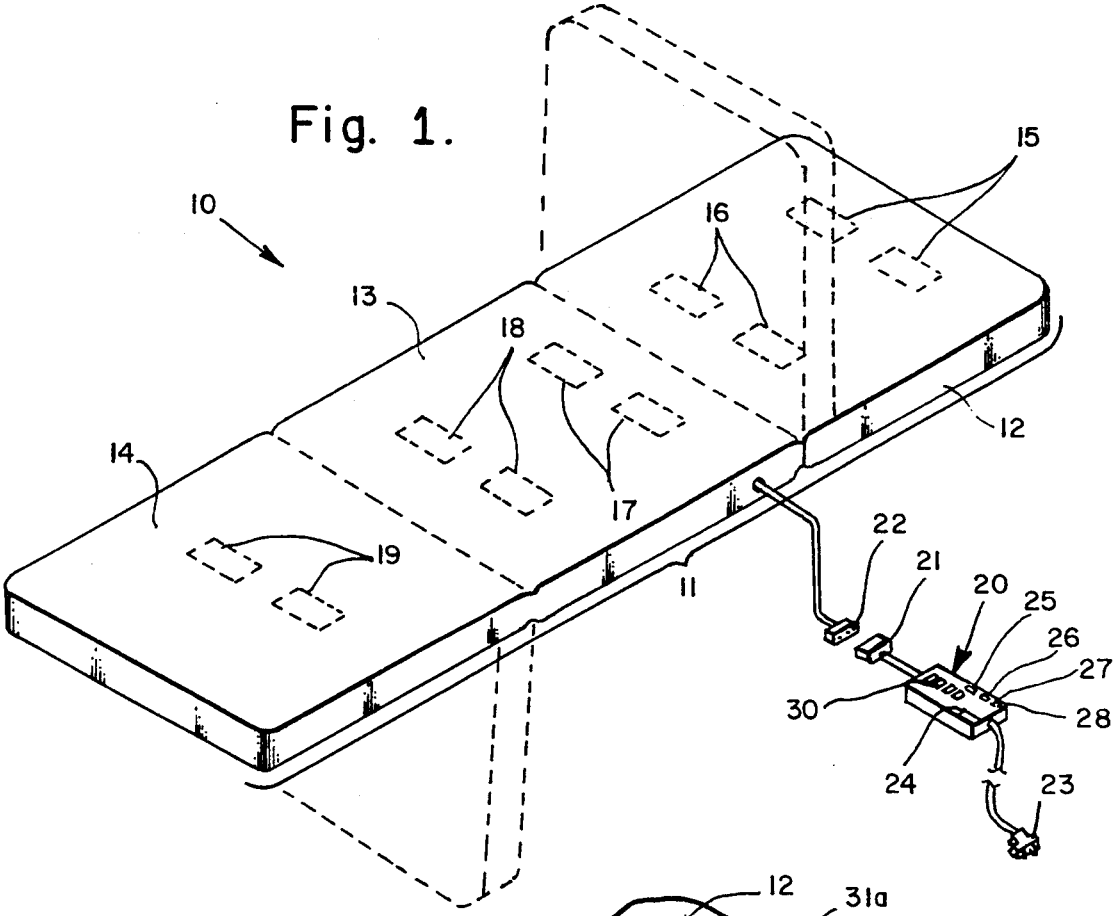
Fig. 2.
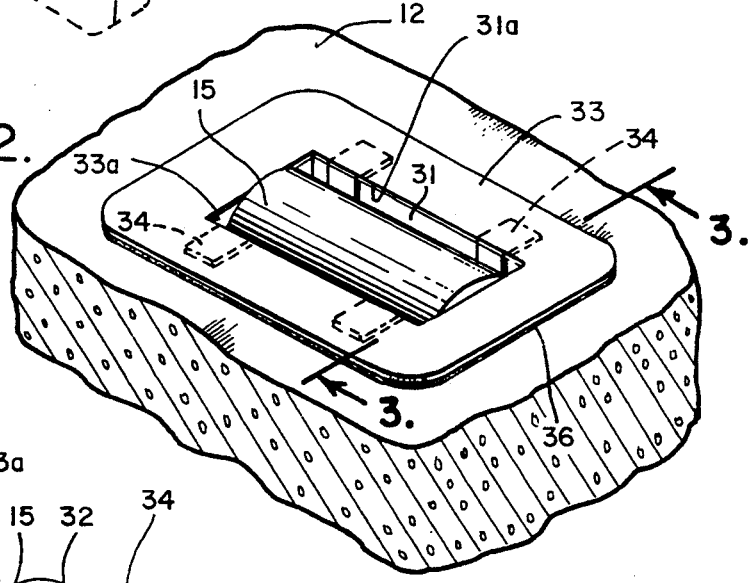
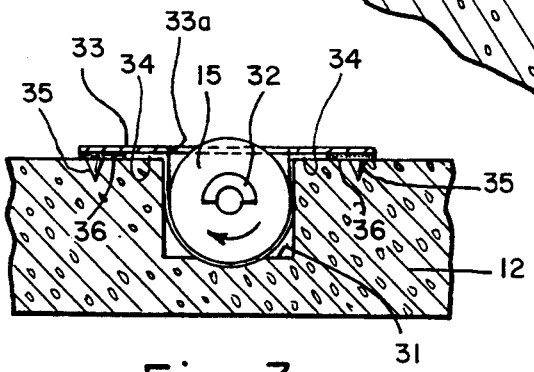
Fig. 3.

MASSAGING APPARATUS WITH SEQUENTIAL VIBRATION

BACKGROUND OF THE INVENTION

1. Field of the Invention

The present invention relates to massaging apparatus, and more particularly to such an apparatus incorporating an array of oscillatory transducers transmitting vibrations to a cushioned member, such as a mattress, chair, seat, pad, or the like, and that provides for singular or simultaneous multiple movements useful in massage of the torso or body parts of the user. Movement or motion, as used herein, refers to simultaneous movements, a single movement, multiple programmable movements separately or in unison, or any combination thereof, and massage includes the production of travelling vibratory motion, rolling motion or even in-place vibratory movement as applied to specified or random areas of the body or user of the apparatus.

2. Brief Description of the Prior Art

In the past, it has been the conventional practice to provide therapeutic chairs having vibrators in the seat and the seat back for imparting a vibratory motion or movement to the person occupying the chair. In other instances, such as when mattresses are employed, a vibrator is placed under or in the box springs or on the bed frame so that vibrating oscillations are transmitted into the structure of the mattress. Such movements are therapeutic to the user's body portions receiving the vibration; however, the movements are extremely limited to mere jiggling or, at best, rapid back and forth movements. Generally, these movements are a series of hard raps to the cushion of the mattress or chair. The imparted movements or vibrations are very local in their reception to the user's body or occupant of the chair or mattress and are usually hard impacts or raps to the bone structure or body physiology of the occupant.

Therefore, a long-standing need has existed to provide a novel massaging or therapeutic apparatus, such as a chair or mattress, having integrally installed transducers arranged in selective groups or arrays which will impart a variety of vibratory movements to the occupant of the chair or mattress and which will move along the legs and back of the occupant in a noticeable rolling manner in order to impart travelling motions.

Controls should be available with pulse generating means and a sequencing means for automatic or manual operation of the vibratory movements.

SUMMARY OF THE INVENTION

Accordingly, the above problems and difficulties are obviated by the present invention which provides a novel massaging or therapeutic apparatus having a cushion member incorporating means for providing a vibrating motion in the member of the apparatus itself for transmittal of the motion and vibrations to a variety of areas of the body of the user. In one form of the invention, a remote sequence controller means provides energy to a plurality of transducers carried in receptacles on the cushion member wherein the transducers are arranged in groups or arrays so that the transducer groups or arrays are driven in accordance with a programmable pattern. In the case of an electrical power source, electrical energy is supplied to a pulse generating network that provides timing and control signals which energize oscillating transducers. Means are employed for mounting the transducers to the cushion member of the apparatus so that the vibrating movements of the transducers are translated into vibrating movements subsequently imparted to the user of the apparatus. Additional means are incorporated into the electrical system for controlling the amount or level of vibration that may take the form of automatic and manual operating circuits, timing circuits, a signal debouncing circuit, and the like. Display and operating means as well as switch controls are connected to the controller means for displaying vital information via lights, graphs, recordings or the like during operation of the apparatus, as well as providing for system turn-on and turn-off capabilities.

Therefore, it is among the primary objects of the present invention to provide a novel massaging or therapeutic apparatus having the means for producing a variety of simultaneous motions to the structure of the apparatus via oscillatory or vibratory movements, generated electromechanically, that are incorporated into the structure of the cushion member itself.

Another object of the present invention is to provide a novel massage or therapeutic means for producing simultaneous motion to selected cushion member areas of the apparatus which takes into account physiological aspects of the human body, such as the position of the spine, legs or the like.

Yet another object of the present invention is to provide a novel massage or therapeutic apparatus in the form of a pad, chair, mattress or the like, having a variety of optional components, such as a monitoring display, stereo sound means and motion-inducing means for providing a plurality of movements to the body of the chair or mattress occupant.

Still another object of the present invention is to provide a novel massaging apparatus having the ability to provide simultaneous dual movements to selected body portions of the occupant, as well as providing a variety of ancillary functions, such as adjustable vibration controls, automatic vibration amplitude limiting and the like.

A further object of the present invention is to provide a novel massaging apparatus having a variety of independent and collective movements so that control is maintained by the occupant or user of the apparatus wherein such control function includes the starting and termination of multiple movements that can be operated singularly, dually, or any combination of movements.

Still a further object resides in providing a closed system having electrical means for pulsing a motor device so as to induce a travelling vibratory motion or movement to the occupant of a pad, chair or mattress via a cushion member as an example.

Another object resides in providing a novel massaging apparatus having an electromechanical or electrical drive means for supplying energization to selected motor transducers in a group of transducer arrays in accordance with a programmable or selected sequence of vibratory or wave motions.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a diagrammatic drawing illustrating the massaging apparatus of the present invention taking the form of a cushion, pad or mattress, and which includes control means for actuating and operating a multiple array or groups of oscillations or vibration generating transducers;

FIG. 2 is an enlarged fragmentary view, in perspective, illustrating a vibration generator carried on the pad shown in FIG. 1;

FIG. 3 is a transverse cross-sectional view of the vibration generator and pad as taken in the direction of arrows 3—3 of FIG. 2;

DESCRIPTION OF THE PREFERRED EMBODIMENT

Figure 4:
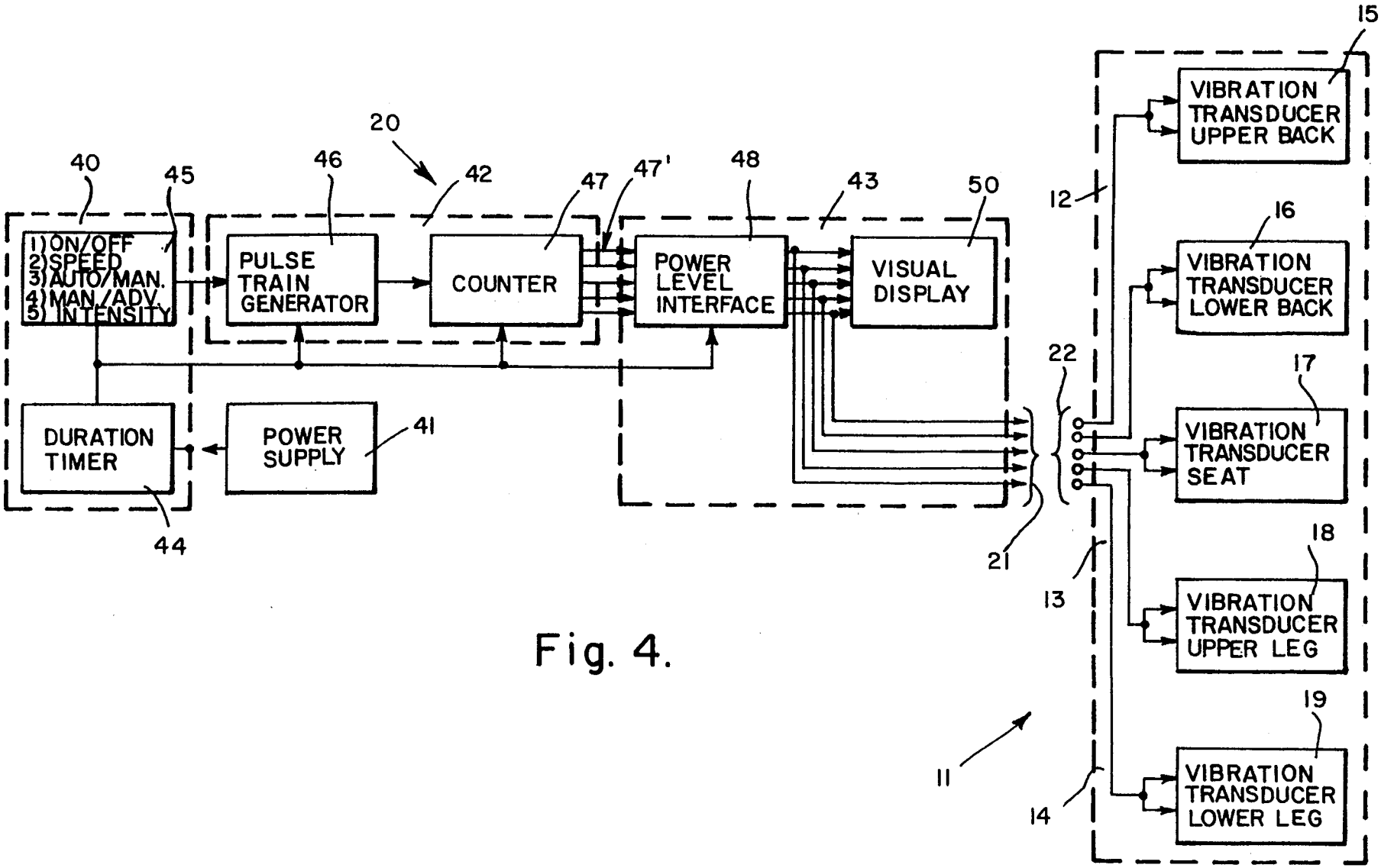
FIG. 4 is a block diagram illustrating an electrical system for energizing the transducers and groups or arrays thereof illustrated in FIG. 1.

Referring to FIG. 1, a massaging apparatus incorporating the present invention is illustrated in the general direction of arrow 10. The novel massaging apparatus may be used-in a variety of forms, such as upholstered items of furniture, as seats, chairs or may even be a separate cushion, mattress or a pad on which the user lies in a prone position. The massaging apparatus 10 as an example includes an elongated pad 11 laid flat, as illustrated in solid lines, and folded, as shown in broken lines, to fit a chair, couch, etc. When folded, an upper section 12 constitutes a seat back while a central or midsection of the pad, identified by numeral 13, constitutes a seat portion while a lower portion when folded downwardly constitutes a lower leg portion 14. As further illustrated, five groups of oscillating or vibrating pairs of transducers are carried on the pad for translating the mechanical movement or motion of each transducer into oscillatory or vibratory motions induced into the material of the pad which, preferably, is composed of an open-celled foam composition. Transducers illustrated by numeral 15 provide a vibratory zone related to the upper back of the person as the person bears against the portion 12 of the pad. Transducers indicated by numeral 16 provide a lower back zone of vibration and transducers 17 provide a zone for the user's seat. The pair of transducers represented by numeral 18 provide vibratory massaging movements for the upper legs while transducers 19 provide a zone for vibratory massaging of the lower legs. These zones are in operation whether the pad is laid out flat or has been folded into a seat configuration. The plurality of transducers which are arranged in the various zones or groups for inducing modulating or vibratory movements into the cushion material are energized or activated in tandem for each group from a common source. This source is represented by a hand-held controller 20 which is coupled to the transducers via a plug 21 and socket 22 after being plugged into a common A/C power source or line via power plug 23.

The controller 20, a manually operated slider control 24, is employed as a speed control while a pushbutton 25 is employed for manual sequencing of the transducers between the various groups or arrays. A 3-position switch 27 is employed for selection between three levels of intensity while a conventional on/off switch 28 is employed as a power switch. A display for indicating the particular zone or group of transducer pairs that are in operation at any one time is displayed by lights, such as light 30.

In the present disclosure, it is noted that the transducers are arranged in multiples, such as pairs, located in a multiplicity of groups or zones across the length of the pad 11. Preferably, transducers and groups or arrays thereof are located relatively in alignment between the opposite ends of the elongated pad inwardly from the edge marginal regions and disposed a substantial distance from the head and foot of the pad so that the array of the transducers is situated in an area where the body of a reclining person would rest. Therefore, transducers 15 are associated with the upper back zone while transducers 16 are associated with a second group associated with the lower back. Again, transducers 17 relate to the seat while transducers 18 pertain to upper legs and transducers 19, the group relating to lower legs. The groups or arrays are arranged in substantially fixed spaced-apart relationship and each group may be composed of two or more transducers of different sizes, weights or dimensions. However, it is to be understood that an array or group of single transducers may also be used to constitute a particular operating zone.

The apparatus of FIG. 1 produces a vibration effect including travelling vibratory movements, localized vibratory or oscillatory motions, rolling movements or combinations thereof by suspending one or more transducers inside the cushioned pad or the like, wherein the transducers are activated or energized by electrical means via the controller 20. The employment of a plurality of such transducers in a multiple of groups provides zones of vibratory movement which may be located in fixed areas, in selectable areas or when programmed appropriately, to move smoothly across the cushion pad surface in a travelling movement. Also, induced vibrations may be programmed to be applied in more complex patterns or even randomly.

Referring now to FIGS. 2 and 3, it can be seen that the vibratory or oscillatory transducers take the form of an electric motor, such as motor 15, which is mounted in a depression or receptacle 31 provided in the face of the pad, such as pad portion 12. The foam composition surrounding the motor is soft and pliable; however, it is stiff enough to carry vibrations from the motor 15 for dispersal throughout the foam composition into the body of the user reclining on the pad 11. The motor 15 includes an eccentric weight 32 mounted on its drive shaft so that a jiggling or oscillating movement is generated as the drive shaft is rotated. The motor 15 is mounted to the underside of a mounting plate 33 by means of a pair of straps, such as straps 34. Downwardly depending spikes, such as spike 35, embed themselves into the foam composition so that the mounting plate 33 will not move once it has been adhesively bonded to the surface of the pad. The adhesive bonding is indicated by an adhesive layer identified by numeral 36. Therefore, it can be seen that as the motor 15 is driven via the electrical circuit, the motor will vibrate by virtue of the eccentric drive shaft arrangement so that oscillating movement will be introduced into the cushion material via the mounting plate so that the immediate area of each motor produces a massaging action into the adjacent body portion of the user.

Referring now in detail to FIG. 4, numeral 20 represents the hand-held controller which provides a switch means 40 permitting the user to select a variety of operations and operating parameters by interconnecting a power supply 41 to a pulse generator 42 so that a timed pulse train is forwarded to an interface means 43 that is connected to the output plug 21 for connection with the input socket 22 leading to the plurality of transducer groups in the pad or mattress 11.

The switch means 40 includes the provision for a duration timing circuit 44 which will automatically shut the power off after a preselected period of time, such as 15 minutes. Within this operating time selection switches 45 are moved by the user not only to turn the unit on and off to supply power but to adjust travelling speed, intensity and a variety of other operating parameters. Once selection of the parameters has been chosen by the operator and the switches so actuated, the power is supplied to a pulse train generator 46 that constitutes a duty cycle of spaced-apart rectangular pulses which are introduced to a counter 47. Once the counter has been actuated, an output is sequentially provided to a power level interface 48. It is to be understood that the sequence is in series and is not a parallel output on all lines since it is this sequence which will determine the automatic energization of the respective transducers in the various zones. However, should the selector switch in the switch means 45 be set at manual, then a single output line from the counter will be activated so that only the selected transducer zone or group will be energized. The power level interface 48 brings the output from the counter to a desired power level for operating of the transducers and the visual display means 50 where the operating lights for the zones, such as light 30, are located. However, the output from the power level interface is provided directly through the plug 21 and socket 22 relationship to the various transducers in the respective zones or groups.

The strength of vibration, as well as speed of motor, is determined by the manual setting of the switches in the switch means 45. The operating parameters derived from switch position will be described later with respect to the circuit description.

Figure 5:
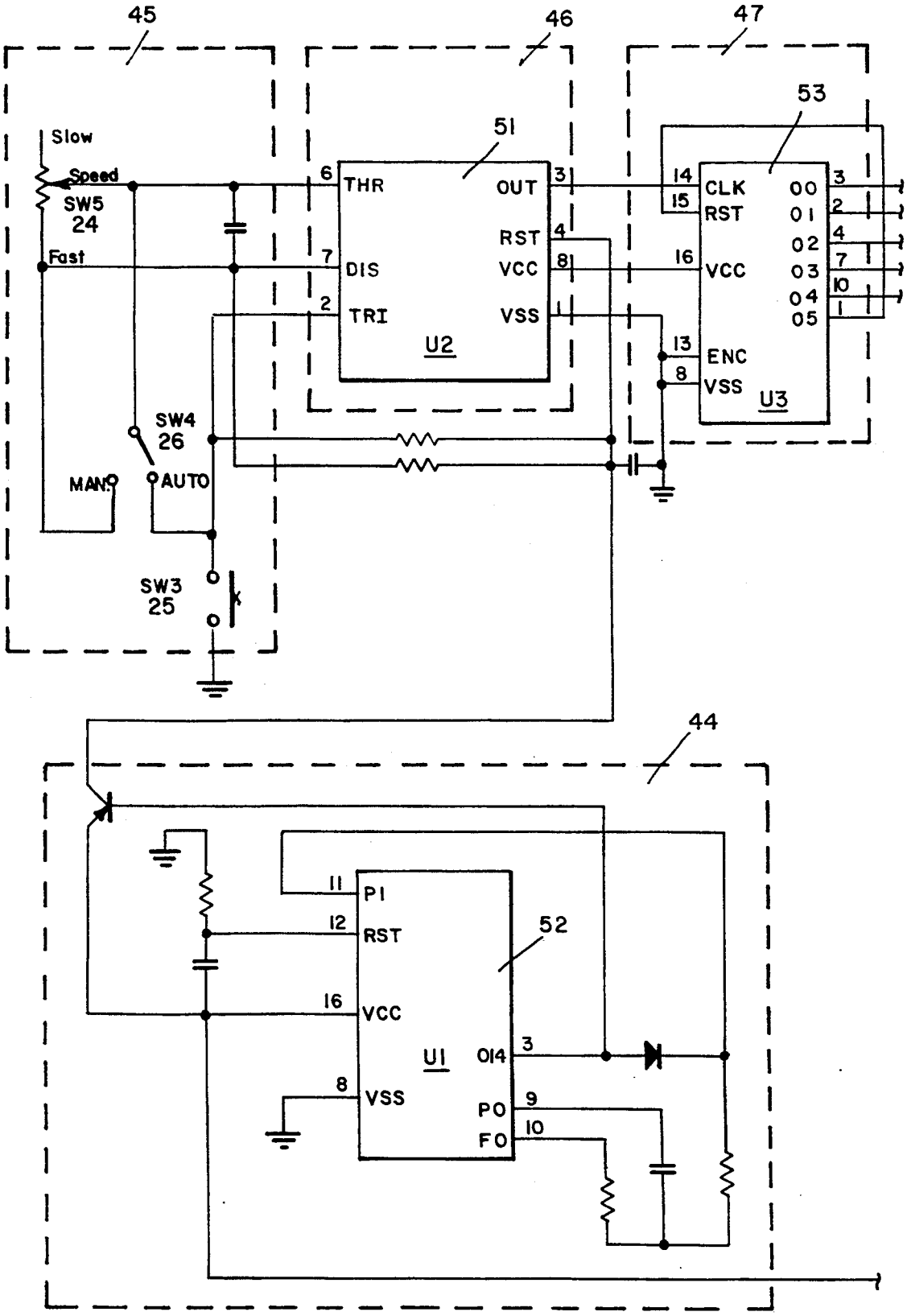
FIGS. 5 and 5*a* depict a circuit schematic of the eletrcial system illustrated in FIG. 4.
Figure 5A:
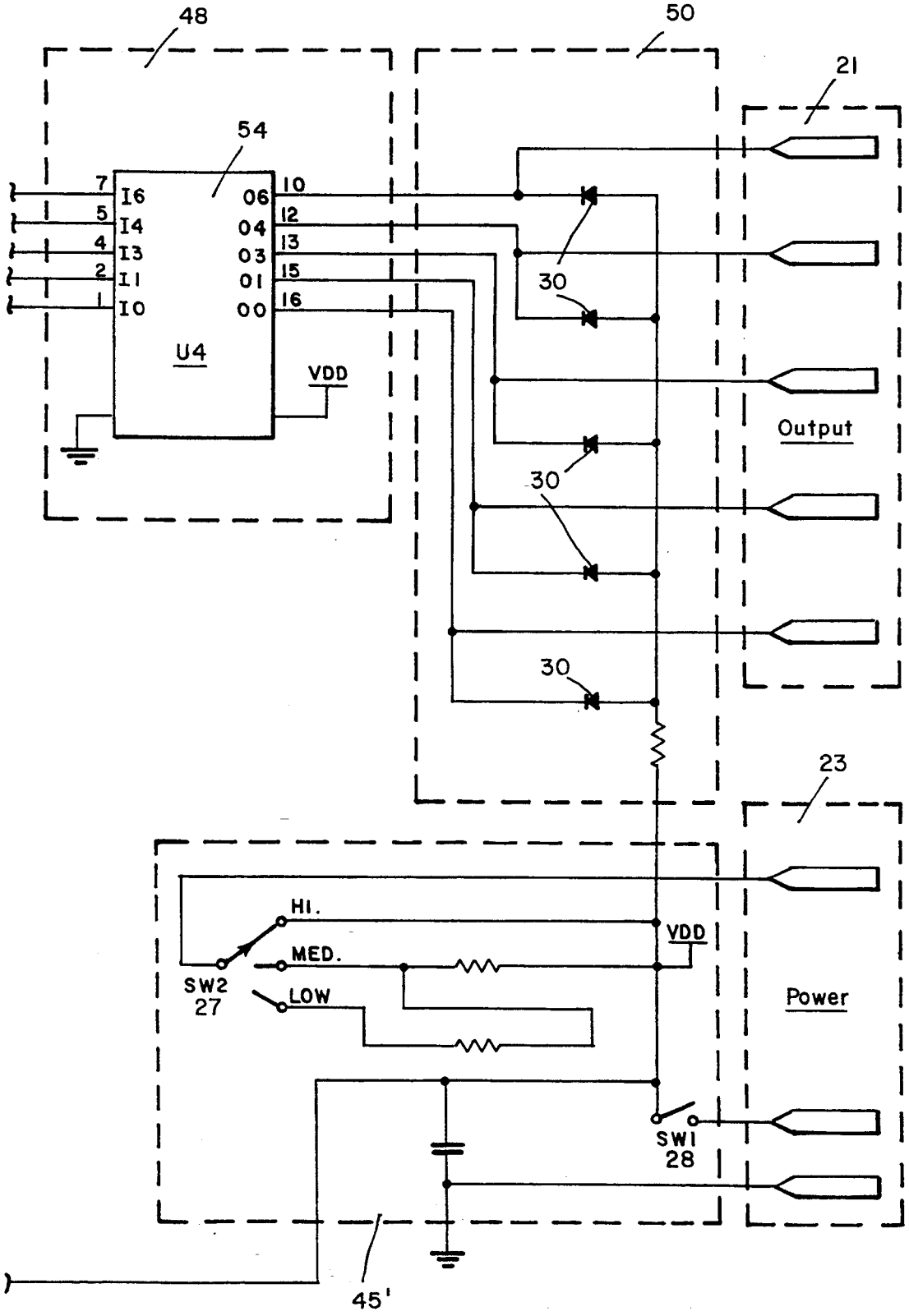

Referring now in detail to FIGS. 5 and 5*a*, it can be seen that the switch arrangement 45 is divided between the blocks 45 and 45' wherein SW1 is the on/off switch connecting the power supply 41 to the unit. It is understood that the power supply includes an A/C adaptor for converting 120 volt AC to a 14 volt DC output for use by the hand-held controller. The switch SW2 is employed for selecting intensity of signal while switch SW3 is a pushbutton type to be used by the user in manually sequencing the application of power to the transducers in the respective zones when the switch SW4 is in the manual position. However, if switch SW4 is in the auto position, the sequence is automatic and the pulsation or movement of the pulses from one body portion to the other is automatic. The slider pot SW5 is employed for selecting travelling speed and includes nomenclature of slow and fast so that the user has a visual view of the two positions as the slider is moved. Movement of the slider resistor selects a repetition rate of the pulse train generated by a multivibrator 51 taking the form of an electronic chip U2 having part number LM555. The chip 51 also operates as a debouncer to feed clean pulses to the counter 53 during manual sequencing operation. The duration timer 44 includes a chip 52 having part number 4060 and is identified by U1. The output from the pulse train generator 46 is to a counter 47 having chip U3, identified by numeral 53, which is part number 4017. The output from the counter 53 is in a spaced sequence along its multiple output lines and is fed directly to the interface circuit 48 having a power chip U4, as identified by numeral 54, and having part number ULN2004A. After the proper power level has been achieved, the output from the interface circuit 48 is provided to the lights 50 for display on the hand-held unit so that the user may know which of the vibrating groups or arrays of transducers are being energized. In parallel, the output from the power level interface is also provided to the respective groups of transducers in the ordered sequence selected by the automatic switch SW4 or the manual setting of the switch when manually sequenced via the manual advance pushbutton SW3.

In view of the foregoing, it can be seen that the massaging apparatus of the present invention is useful in the field of vibration for the comfort and therapeutic purposes as applied to a user and which may be incorporated into a variety of consumer items, such as mattresses as used in bed furnishings, reclining type chairs, and a lightweight, easily transportable foam pad which is approximately six feet long by two-and-a-half feet wide and three inches thick. When used as a pad, the pad may fold over upon itself and a handle may be provided for easy carrying. All of the above products, mattress, recliner, portable pad and the like are divided into five massaging zones, each zone associated with specific body areas, such as upper back, lower back, seat, upper leg and lower leg. Generally, these will be product designs using foam inner cores or cavities intended to be occupied by vibrating or oscillatory transducers so as to provide resilient and comforting massaging movements. Each area contains at least two small direct current motors spinning an eccentric weight to cause the vibration. The motor assemblies are embedded in the foam cores or cavities which accept the motor assembly dimensions, and the assembly is fastened with a suitable adhesive, including the mounting plate, to the foam in order to permanently retain the motor and mounting plate position.

The hand controller 20 is similar in appearance to a cable wired TV or VCR remote control and it contains the electronics which operate the motors in either an automatic or a manual mode. In automatic, power is applied to each area motor pair sequentially from "upper back" (shoulder blade area) to "lower leg" (shin area) then back to shoulders and continuing in this circulating "wave motion" manner. The rate or speed is continuously variable with a slider on the hand controller with a dwell time from approximately 10 seconds down to 1 second on each zone. In the manual mode, any zone or pair of motors can be energized at user's selection and will be allowed to remain in the chosen location until manually stopped or changed by means of the user using the pushbutton switch.

An overriding timer function whenever the system is turned on is employed to automatically shut the system off after a period of 15 minutes. To restart another operating sequence, the on/off switch must be turned on again. Power is supplied to the system by a wall adaptor rated at 14 volts DC at 500 ma. Only the motors are installed in the furnishings. All other electronics are in the hand control.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A massaging apparatus comprising a cushion, a plurality of vibrators coupled to said cushion for imparting vibratory energy thereto and to a user, a control means for automatically and sequentially energizing said vibrators, said control means including pulse generator means for generating a train of electric rectangular shaped pulses, counter means for converting the train of pulses into a series of pulses on multiple output lines, and a power level interface between the lines and said vibrators, whereby the pulses are selectively and sequentially applied to independent ones of said vibrators.

2. Apparatus according to claim 1 in which said pulse generator includes a multivibrator.

3. Apparatus according to claim 2 further including a display for indicating which of said vibrators is vibrating, and wherein said power level interface is coupled to said vibrators and said display.

4. Massaging apparatus comprising the combination of:

a cushioned structure;

a plurality of transducers including vibration producing means operably mounted to said cushioned structure for generating a vibratory movement in a predetermined pattern;

hand-held circuit means including pulse drive means, pulse generating means and switching means exterior of said cushioned structure;

said pulse drive means coupled to said plurality of transducers for providing a train of pulses thereto;

said pulse generating means coupled to said pulse drive means for enabling said pulse drive means to generate the train of pulses provided to said transducers;

said switching means coupled to said pulse generating means and selectively switchable for enabling said pulse generating means to operate in one of an automatic and a manual mode;

said pulse generating means, when operable in its automatic mode, enabling said pulse drive means to apply the train of pulses to said plurality of transducers in a selected sequence so that selected ones of said transducers independently vibrate in response to one pulse of the train of pulses;

said switching means including manually operated switch means;

said pulse generating means, when operable in its manual mode, enabling said pulse drive means to selectively apply a pulse to a particular one of said plurality of transducers in response to successive operation of said manually operated switch means; and an intensity controlling means coupled between said pulse drive means and said transducers for adjusting the magnitude of the vibratory movement.

5. A massaging apparatus comprising:

an elongated cushion composed of a resilient material;

a plurality of vibratory devices carried on said cushion in fixed spaced-apart relationship constituting a multiplicity of massaging zones across the length of said cushion;

a controller having electrical circuit means for selectively supplying energy independently to said vibratory devices;

said circuit means including electrical pulse generating and counter sequence means electrically coupled to and energizing said vibratory devices to supply a train of pulses thereto in a predetermined pattern to progressively and sequentially provide vibratory motion to said multiplicity of massaging zones in an automatic mode in a continuously repeating manner;

means coupled to said sequence means for independently operating selected ones of said vibratory devices in a manual mode whereby said selected ones of said vibratory devices operate in response to manual selection thereof;

a plurality of spaced-apart cavities in said cushion arranged in a predetermined pattern defining said multiplicity of massaging zones;

mounting means including mounting plates for each of said vibratory devices, each of said plates being aligned with a respective one of said cavities whereby each said plate engages the edge marginal region of said cushion about each of said respective cavities; and said mounting means further including retaining means securing each of said vibratory devices rigidly to its respective plate and said plates to said cushion.

6. The invention as defined in claim 5 wherein:

said elongated cushion includes at least two sections foldable with respect to each other, each section carrying selected ones of said vibratory devices associated with selected massaging zones.

7. The invention as defined in claim 8 wherein:

said vibratory device is a motor having an eccentric drive shaft producing vibrations induced into said cushion.

8. The invention as defined in claim 7 in which said manual mode means includes a manually actuable and momentarily contactable switch for manually advancing the vibratory motion among said massaging zones.

9. Massaging apparatus according to claim 4 for massage of a user in which said cushioned structure has a plurality of cavities arranged in the predetermined pattern in fixed spaced-apart relationship, and further comprising:

individual mounting means each carrying a respective one of said vibration producing means for securing said vibration producing means within respective ones of the cavities in said cushioned structure in the predetermined pattern and for conducting the vibratory movement from said vibration producing means to the user;

a plurality of plates, one for each of the cavities, respectively carried on said cushioned structure about each of the cavities respectively supporting said vibration producing means in the cavities; and rigid retaining means rigidly holding each of said vibration producing means to said respective plates.

10. A massaging apparatus comprising:

a cushion;

a plurality of vibrators secured to said cushions for imparting vibratory energy thereto and to a user, a control means for automatically and sequentially energizing said vibrators, said control means including pulse train generator means for generating a series of pulses in which each pulse is of sufficient duration in time as to enable each of said vibrators to vibrate in a sequential manner;

a counter electrically coupled to said pulse train generator for receiving the series of pulses and for producing a plurality of independent outputs therefrom through counter output line means;

a power level interface circuit electrically coupled to said counter for receiving the outputs therefrom and for transmitting the outputs to said vibrators; and a power supply electrically coupled to said generator and said vibrators for energization thereof.

11. Apparatus according to claim 10 further comprising automatic/manual mode operation means coupled to said generator means for respective automatic and manual actuation thereof, said automatic mode operation means including means for generating a repetitive train of the pulses.

12. Apparatus according to claim 11 in which said automatic/manual mode operation means includes:

a switch alternately positionable for selecting one of automatic and manual operation of said generator.

13. Apparatus according to claim 12, for manual mode operation, in which said automatic/manual mode operation means further includes:

a manually operated switch coupled to said generator for enabling activation of one of said counter output line means for selective energization of said vibrators, when said alternately positionable switch is positioned to enable the manual mode operation.

14. Apparatus according to claim 13 further including means coupled to said interface circuit for providing a visual display of those of said energized vibrators which are energized.

15. Apparatus according to claim 12, for automatic mode operation, in which said automatic/manual mode operation means further includes:

means for varying the rate of repetition of the pulses coupled to said generator by said switch when said switch is positioned to enable the automatic mode operation; and circuitry for enabling said counter output to be applied in sequence to said vibrators.

16. Apparatus according to claim 15 further including means coupled to said interface circuit for providing a visual display of those of said vibrators which are energized.

17. Apparatus according to claim 10 further including means coupled to said power supply for limiting the time of operation of said vibrators.

18. Apparatus according to claim 17 in which said operation time limiting means comprises a pulse counter for preventing Dower to be supplied to said generator and said generator-coupled counter.

19. Apparatus according to claim 10 further including means coupled to said vibrators for establishing an intensity level of energization thereof.

20. Apparatus according to claim 15 in which said rate varying means comprises a variable resistor.

21. Apparatus according to claim 4 in which said pulse generator includes rectangular wave generating circuitry.

22. Apparatus according to claim 4 in which said pulse generator includes a multivibrator.

* * * * *

UNITED STATES PATENT AND TRADEMARK OFFICE

CERTIFICATE OF CORRECTION

PATENT NO. : 5,437,608

DATED : 01 August 1995

INVENTOR(S) : Stanley Cutler

It is certified that error appears in the above-indentified patent and that said Letters Patent is hereby corrected as shown below:

In the cover page, Item [63]
--Related U.S. Application Data
Continuation of Ser. No. 07/702,769,
May 03, 1991, abandoned.--;

In the cover page, right hand column, in the Abstract, line 7,
delete "automatic or" and insert therefor:
--automatically or a--;

Column 1, between lines 5 and 6, insert the paragraph:
--This is a continuation of application Serial
No. 07/702,769 filed 03 May 1991, now abandoned.--;
lines 8-9, delete "incorporating" and insert therefor:
--that incorporates--;
line 37, after "mattress" insert: --,-- (a comma);
line 56, before "member" insert: --cushion--; and
line 61, delete "wherein" and insert therefor: --, and--.

Column 2, line 6, delete "that" and insert therefor: --, and--;
line 12, before "providing" insert: --for--;
line 12, after "providing" delete "for".
line 27, after "spine" delete "," (the comma) and
insert therefor: --and the--;
line 27, delete "or the like";
line 30, delete "or" and insert therefor: --and--;
line 37, delete "to provide" and insert therefor:
--of providing--;
line 38, after "as well as" insert: --of--;
line 40, delete "," (the comma) and insert therefor:
--and--; and
line 41, delete "and the like." and insert therefor:
--.-- (a period).

Column 3, line 4, delete "taking" and insert therefor:
--which takes--;
lines 18-19, delete "eletrcial" and insert therefor:
--electrical--;

UNITED STATES PATENT AND TRADEMARK OFFICE

CERTIFICATE OF CORRECTION

PATENT NO. : 5,437,608

DATED : 01 August 1995

INVENTOR(S) : Stanley Cutler

It is certified that error appears in the above-indentified patent and that said Letters Patent is hereby corrected as shown below:

Column 3, line 26, delete "used-in" and insert therefor:
--used in--;
line 31, delete "and" and insert therefor: --or--;
lines 32-37, delete "When folded, an ... five groups of" and insert therefor:
--When pad 11 is folded, an upwardly folded end section 12 constitutes a back portion, a central or midsection 13 constitutes a seat and upper leg portion, and a downwardly folded end section 14 constitutes a lower leg portion.
As further illustrated, five groups of--;
line 38, after "transducers" insert: --15-19--;
line 39, after "mechanical" insert:
--, for example, rotary--;
line 43, after "15" insert: --in a first group--;
line 46, after "16" insert: --of a second group--;
line 46, delete "lower back";
lines 46-47, delete "and transducers" and insert therefor: --for the lower back. Transducers--;
line 47, after "17" insert: --of a third group--;
line 48, after "18" insert: --of a fourth group--;
line 50, after "19" insert: --of a fifth group--;
line 52, delete "has been" and insert therefor: --is--;
line 53, after "transducers" insert --,-- (a comma);
line 56, after "material" insert --,-- (a comma);
line 62, delete ", a" and insert therefor:
--is used to perform several functions. A--;
line 63, delete "," (the comma);
line 63, delete "while a" and insert therefor: --. A--;
line 65, delete "between" and insert therefor: --among--;
line 67, delete "while a" and insert therefor:
--. A--; and

UNITED STATES PATENT AND TRADEMARK OFFICE

CERTIFICATE OF CORRECTION

PATENT NO. : 5,437,608

DATED : 01 August 1995

INVENTOR(S) : Stanley Cutler

It is certified that error appears in the above-indentified patent and that said Letters Patent is hereby corrected as shown below:

Column 3, line 68, delete "for indicating" and insert therefor: --30, for example of lights, indicates--.

Column 4, lines 2-3, delete "is displayed by lights, such as light 30." and insert therefor: --.-- (a period--;
lines 4-5, after "transducers" insert: --15-19--;
line 5, after "pairs," insert: --and are--;
line 6, after "groups" insert: --, arrays--;
line 7, after "Preferably," insert: --both the--;
line 7, after "and" insert: --the--;
line 8, delete "relatively";
lines 8-10, delete "between the opposite ... regions and disposed" and insert therefor: --with one another--;
lines 10-11, after "distance" insert: --inwardly--;
line 11, delete "and" and insert therefor: --,-- (a comma);
line 11, after "foot" insert: --and sides--;
line 11, delete "array" and insert therefor: --arrays--;
line 12, delete "is" and insert therefor: --are--;
line 12, delete "in an area";
line 16, after "back" insert: --zone--;
line 17, before "upper" insert: --the--;
line 17, delete "legs" and insert therefor: --leg zone--;
line 18, delete ", the group relating" and insert therefor: --relates--;
line 18, before "lower" insert: --the--;
line 18, delete "legs" and insert therefor: --leg zone--;
line 42, after "depression" insert: --, cavity--;
line 42, after "depression" insert: --, cavity--;
line 43, before "The" insert: --Cavity 31 thereby forms an edge marginal region 31a on the face of pad or cushion 11.--

UNITED STATES PATENT AND TRADEMARK OFFICE

CERTIFICATE OF CORRECTION

PATENT NO. : 5,437,608

DATED : 01 August 1995

INVENTOR(S) : Stanley Cutler

It is certified that error appears in the above-indentified patent and that said Letters Patent is hereby corrected as shown below:

Column 4, line 52, after "34." insert:
--Plate 33 is provided with an opening 33a for enabling motor 15 to be placed within cavity 31.--
lines 53-54, delete "embed themselves" and insert therefor: --are embedded--; and
line 56, after "to" insert:
--edge marginal region 31a of--.

Column 5, line 42, after "SW1" insert:
--in block 45′ (shown as switch 28 in FIGURE 1)--;
line 46, after "SW2" insert:
--in block 45′ (shown as switch 27 in FIGURE 1)--;
line 47, delete "selecting" and insert therefor:
--controlling the amplitude of the current supplied to the motors in order to control vibration--;
line 47, delete "signal while switch" and insert therefor: --each motor or motor pair. Switch--;
line 48, after "SW3" insert:
--in block 45 (shown as switch 25 in FIGURE 1)--;
line 51, after "SW4" (first occurrence) insert:
--in block 45 (shown as switch 26 in FIGURE 1)--;
line 52, after "automatic" delete "and" and insert therefor: --, thus obviating the need and function of switch SW3, so that--;
line 54, delete "to the other" and insert therefor:
--or zone to another--;
line 54, delete "slider pot SW5" and insert therefor:
--placement of switch SW4 in its auto position also inserts a potentiometer or variable resistor VR1 into circuit. Potentiometer VR1, which is also depicted in FIGURE 1 as slider control 24,--;
line 58, after "resistor" insert: --VR1--;
line 59, after "51" insert:
--in pulse train generator 46--;

UNITED STATES PATENT AND TRADEMARK OFFICE

CERTIFICATE OF CORRECTION

PATENT NO. : 5,437,608 Page 5 of 5

DATED : 01 August 1995

INVENTOR(S) : Stanley Cutler

It is certified that error appears in the above-indentified patent and that said Letters Patent is hereby corrected as shown below:

Column 5, line 60, after "U2" insert: --in generator 46--;
line 61, after "51" insert: --in generator 46--;
line 62, after "53" insert: --in counter 47--;
line 63, after "operation" insert: --to ensure the desired order of sequencing and to avoid erratic motor energization--; and
line 63, after "a" insert: --pulse counting--.

Column 6, line 6, after "unit" insert: --or controller 20--;
line 9, after "interface" insert: --48--;
line 11, delete "automatic";
line 11, after "SW4" insert: --in block 45 when set in its automatic position,--;
line 12, after "switch" insert: --SW4--;
line 13, after "SW3" insert: --in block 45--;
line 55, after "function" insert: --is provided by duration timer 44 and its pulse counting chip 52 in combination with transistor Q1,--; and
line 56, after "on" insert: --, and--.

Column 8, line 32, (Claim 7) delete "8" and insert therefor: --6--.

Column 10, line 21, (Claim 18) delete "Dower" and insert therefor: --power--.

Signed and Sealed this

Fifth Day of March, 1996

*Attest:*

Bruce Lehman

BRUCE LEHMAN

*Attesting Officer*

*Commissioner of Patents and Trademarks*